United States Patent [19]

Abeln

[11] Patent Number: 4,924,645

[45] Date of Patent: May 15, 1990

[54] COMPOSITE FLOOR STRUCTURE AND PROCESS FOR THE PRODUCTION THEREOF

[75] Inventor: Maarten A. M. Abeln, Istanbul, Turkey

[73] Assignee: Stichting Istaned, Woudenberg, Netherlands

[21] Appl. No.: 318,600

[22] Filed: Mar. 3, 1989

[30] Foreign Application Priority Data

Mar. 11, 1988 [NL] Netherlands ..... 8800611

[51] Int. Cl.[5] ..... B44D 5/08

[52] U.S. Cl. ..... 52/177; 52/404; 52/408; 52/741

[58] Field of Search ..... 52/177, 408, 404, 741

[56] References Cited

FOREIGN PATENT DOCUMENTS

| | | |
|---|---|---|
| 823500 | 12/1951 | Fed. Rep. of Germany . |
| 1941662 | 5/1970 | Fed. Rep. of Germany . |
| 2098568 | 3/1972 | France . |
| 2505906 | 11/1982 | France . |
| 2560256 | 8/1985 | France . |
| 2583448 | 12/1986 | France . |

*Primary Examiner*—Carl D. Friedman

*Attorney, Agent, or Firm*—Young & Thompson

[57] ABSTRACT

Composite floor structure comprising a metallic carrier section (4) filled with sound proofing grannular material (5) on which an elastic deformable separating layer (6) is placed finished with a convering layer (7).

8 Claims, 1 Drawing Sheet

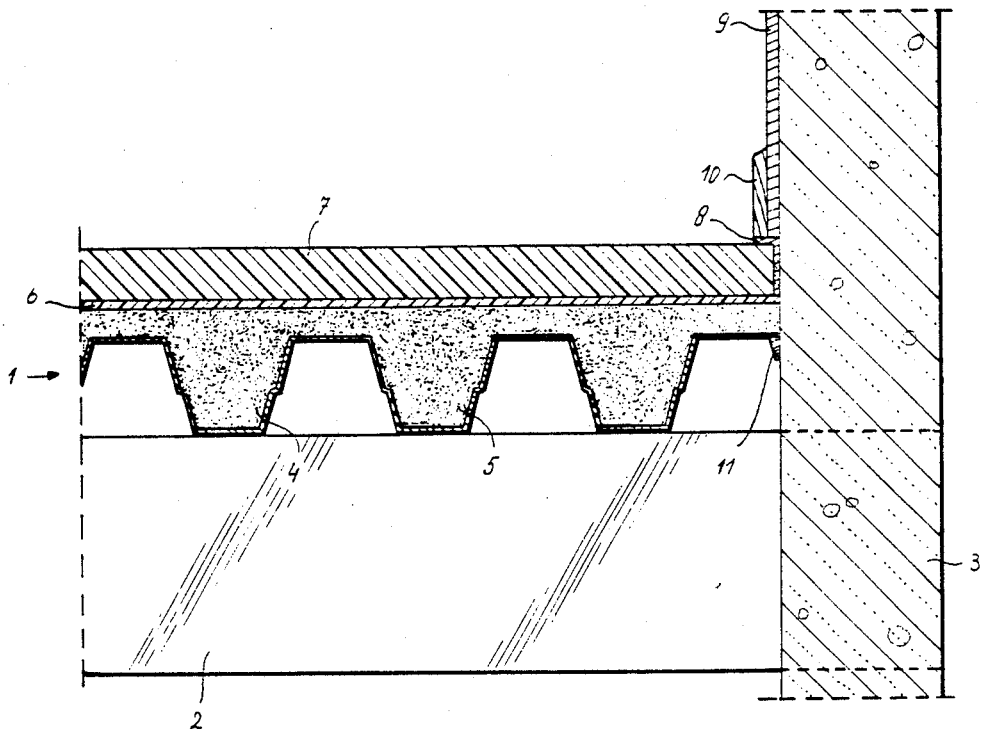
9
10
8
7
6
1
4
5
11
3
2

COMPOSITE FLOOR STRUCTURE AND PROCESS FOR THE PRODUCTION THEREOF

The invention relates to a composite floor structure, when installed comprising a metallic carrier section filled with soundproofing granular material on which a cohesive covering layer is placed.

Such a floor structure is known from DE-PS 823,500. This publication describes with reference to FIG. 5 a channel section in which a granular material is placed. A number of such channel-type sections placed side by side are filled in this way and, finally, a covering layer of a hard material, such as concrete, covering all these channel-type sections is applied.

This composite floor structure has the disadvantage that the sound-proofing properties are particularly poor because the metallic carrier sections are in direct contact with the hard finishing layer, so that sound from floor covering placed thereon is transmitted directly to the metallic carrier section and thus causes noise nuisance.

The object of the present invention is to avoid this disadvantage. This object is achieved with a composite floor structure of the type described above in that an elastically deformable separating layer is placed between the sound-proofing material and the covering layer. Providing an elastically deformable separating layer between the covering layer and the metallic section/granular material prevents contact noise from being transmitted to the metallic carrier section.

According to an advantageous embodiment of the above-described composite floor structure, the metallic section is a sheet piling section. This means that it is no longer necessary to connect different section parts to each other in a complicated and laborious manner. It is pointed out that the use of a sheet piling section as such is known from FR-A-2,560,256. However, unlike the case of the present application, this section is filled with concrete and not with a sound-proofing material. The sound-proofing material is preferably granular material. A relatively cheap sound-proofing granular material is sand. The covering material is preferably slightly flexible. This contrasts with conventional decking which cannot absorb any movement at all. It is preferable to use an anhydrite material for the covering layer. The separating layer is preferably felt which, in addition to the separating action, is particularly good for sound absorption. Pure polypropylene felt is preferred, because microbes or rotting are thereby prevented.

The invention also relates to a process for producing a floor of the type described above. This process involves the fitting of the metallic carrier sections or girders, followed by filling with the sound-proofing material. The separating layer can then be placed if necessary and, finally, the covering layer is applied.

The invention will be explained in greater detail below with reference to the example of an embodiment shown in the single figure of the drawing.

In the figure the composite floor structure according to the invention is indicated in its entirety by 1. It rests on a girder 2 which is placed in an only partially shown skeleton 3 of a building structure. The composite floor structure comprises a metallic carrier section 4, a so-called sheet piling section. This section consists of a series of channel-type parts. It is preferably an iron section, and the wall thickness can be approx. 1 mm. This sheet piling section 4 is filled with sound-proofing material 5. This sound-proofing material is preferably a granular material such as sand. A type of sand found to be particularly good was "Bijleveld sand". A separating layer 6 is then placed on the sound-proofing material. It can be a felt material comprising pure polypropylene. The thickness of this layer was 6 mm in an example of an embodiment. A covering layer 7 comprising anhydrite material, for example material which is known on the market as "Resaplan", is placed on top of this. In order to prevent the transmission of sound from the covering layer 7 to skeleton 3, a layer of soundinsulating material such as polyethylene foam is applied at the end of covering layer 7. The masonry 9 and skirting board 10 can connect to this. At the place where the pile sheeting section 4 joins the skeleton 3 a polyurethane foam seal 11 can be applied.

A floor achieved in this way had a total thickness of 12 cm and a strength comparable to a concrete floor 15 cm thick. Both the acoustic and the strength properties were at least as good as those of a concrete floor. The weight of the floor was half that of the above-described concrete floor. The cost was also much lower.

Although the embodiment described above is a preferred embodiment, it must be understood that numerous modifications can be made thereto without going beyond the scope of the present invention. For example, the shape of the sheet piling sections 4 can be adapted to the required strength properties. Moreover, instead of the materials specifically mentioned here, other materials with suitable properties which are generally known in the state of the art can be chosen. BO 35065

I claim:

1. Composite floor structure, when installed comprising a metallic carrier section filled with sound-proofing granular material on which a cohesive covering layer is placed, wherein an elastically deformable separating layer is placed between the sound-proofing material and the covering layer.

2. Floor structure according to claim 1, in which the metallic section is a sheet piling section.

3. Composite floor structure according to claim 2, in which the sound-proofing material is filled up to a level above the highest point of the sheet piling section.

4. Floor structure according to claim 1, in which the covering layer is a slightly flexible layer.

5. Floor structure according to claim 4, in which the covering layer is an anhydrite material.

6. Floor structure according to claim 1, in which the separating layer is a felt-type material.

7. Floor structure according to claim 1, in which the separating layer is a polypropylene-based material.

8. Process for the production of a floor structure comprising a metallic carrier section filled with sound-proofing granular material on which a cohesive covering layer is placed with an elastically deformable separating layer disposed between the sound-proofing material and the covering layer, the process comprising the placing of the metallic carrier section on horizontal girders, filling of the carrier section with sound-proofing material, followed by placing of the separating layer, and then the application of the covering layer.

* * * * *